US011253115B1

(12) United States Patent
Level

(10) Patent No.: US 11,253,115 B1
(45) Date of Patent: Feb. 22, 2022

(54) TOILET SEAT LIFTING APPARATUS

(71) Applicant: Jack R. Level, Plano, TX (US)

(72) Inventor: Jack R. Level, Plano, TX (US)

( * ) Notice: Subject to any disclaimer, the term of this patent is extended or adjusted under 35 U.S.C. 154(b) by 0 days.

(21) Appl. No.: 17/170,860

(22) Filed: Feb. 8, 2021

Related U.S. Application Data

(63) Continuation of application No. 16/410,795, filed on May 13, 2019, now abandoned.

(51) Int. Cl.
*A47K 13/10* (2006.01)

(52) U.S. Cl.
CPC ..... *A47K 13/10* (2013.01)

(58) Field of Classification Search
CPC ..... A47K 13/10
See application file for complete search history.

(56) References Cited

U.S. PATENT DOCUMENTS 2,232,895 A * 2/1941 White ..... A47K 13/10 4/246.5
5,504,947 A * 4/1996 Robellop ..... A47K 13/10 4/246.1
5,852,833 A * 12/1998 Gregoire ..... A47K 13/10 4/246.3

* cited by examiner

*Primary Examiner* — Janie M Loeppke
(74) *Attorney, Agent, or Firm* — Jeffrey Roddy

(57) ABSTRACT

An apparatus for moving a toilet seat from a closed position adjacent a toilet bowl to a raised position includes an actuator attached to a foot pedal. Pressing the foot pedal moves the actuator in a forward stroke such that nearing the end of the forward stroke an end of the actuator is pivoted and elements connected to the actuator bear against an underside of the toilet seat, raising the seat away from the bowl.

3 Claims, 10 Drawing Sheets

TOILET SEAT LIFTING APPARATUS

This non-provisional application claims benefit to U.S. non-provisional application Ser. No. 16,410,795 having a filing date of May 13, 2019 and entitled "Toilet Seat Lifting Apparatus"

FIELD OF THE INVENTION

The invention relates generally to mechanisms for the assisted lifting of a toilet seat and lid that does not require a user to contact the toilet seat or lid.

BACKGROUND OF THE INVENTION

Various apparatus for the assisted lifting of a toilet seat are known in the art. U.S. Pat. No. 2,251,770 to Warner describes a pair of actuators, each actuating either a toilet lid or a toilet seat. U.S. Pat. No. 2,776,440 to Miller describes a toilet seat lifter that is foot actuated. U.S. Pat. No. 3,303,517 to Wood et al., describes a toilet seat lifter that is also foot actuated. Yet another foot actuated lifter is disclosed in U.S. Pat. No. 4,803,741. More recently, US Pub. No. 2009/0113611 by Jarjour et al., describes a toilet seat lifter that is counterweight driven. Other seat lifting apparatus have been described in the past and all suffer from mechanical complexity and multiple hard to clean surfaces. Difficult to clean surfaces, especially in restrooms, are particularly troublesome owing to the increase in hospital or nursing home acquired infections.

It would be desirable to provide a toilet seat lifter having minimal moving parts and employing curved surfaces that easy to clean.

It would be even more desirable of larger sections of the foregoing seat lifter were easily removable when needed from the toilet assembly enabling a thorough cleaning.

It would be further desirable for such a seat lifter to be hand or foot actuated.

SUMMARY OF THE INVENTION

One general example implementation of a toilet seat lifting apparatus includes a single actuator with a forward and reverse stroke, and the actuator is both linearly movable and pivoting during the forward and reverse strokes. Portions of the apparatus are affixed to a bowl of a toilet assembly. The term "toilet assembly" as used herein means a toilet pedestal with a bowl, a bowl rim, and at least a toilet seat attached to a top surface of the bowl.

In a first aspect combinable with the general implementation, the actuator includes a foot plate portion.

In a second aspect combinable with any of the previous aspects, the actuator includes a guide that resides atop a toilet bowl rim which serves as a sliding surface for the guide.

In a third aspect combinable with any of the previous aspects, the guide may mate with a slotted member attached to the bowl rim.

In a fourth aspect combinable with any of the previous aspects, the apparatus includes an upper pivot member movable by the actuator.

In a fifth aspect combinable with any of the previous aspects, the apparatus includes a coupler configured to receive the upper pivot member, the coupler disposed between the underside of the toilet seat and the rim of the bowl.

In a sixth aspect combinable with any of the previous aspects, the upper pivot member is connected to and pivotable within the coupler.

In a seventh aspect combinable with any of the previous aspects, the guide and upper pivot member are configured to move together when the actuator is moved.

In an eighth aspect combinable with any of the previous aspects, the coupler may be unaffixed or affixed to the underside of the toilet seat.

In a ninth aspect combinable with any of the previous aspects, a lower pivotable member is connected to the coupler.

In a tenth aspect combinable with any of the previous aspects, the lower pivotable member is connected to an anchoring member, and the anchoring member is affixed to the top surface of the bowl, adjacent the seat.

In an eleventh aspect combinable with any of the previous aspects, the lower pivotable member is pivotable within the coupler.

In a twelfth aspect combinable with any of the previous aspects, a portion of the lower pivotable member is pivotable within the anchoring member.

In a thirteenth aspect combinable with any of the previous aspects, the actuator is configured to move forward, and at the end of its forward movement, a distal end of the actuator is configured to pivot upwardly.

In a fourteenth aspect combinable with any of the previous aspects, the actuator is configured to move rearward, and at the beginning of its rearward movement, a distal end of the actuator is configured to pivot downwardly.

These general and specific aspects may be implemented using a device, system or method, or any combinations of devices, systems, or methods. The details of one or more implementations are set forth in the accompanying drawings and the description. Other features, objects, and advantages will be apparent from the description and drawings, and from the claims.

BRIEF DESCRIPTION OF THE DRAWING FIGURES

REFERENCE LISTING OF THE NUMBERED ELEMENTS

Figure 1:
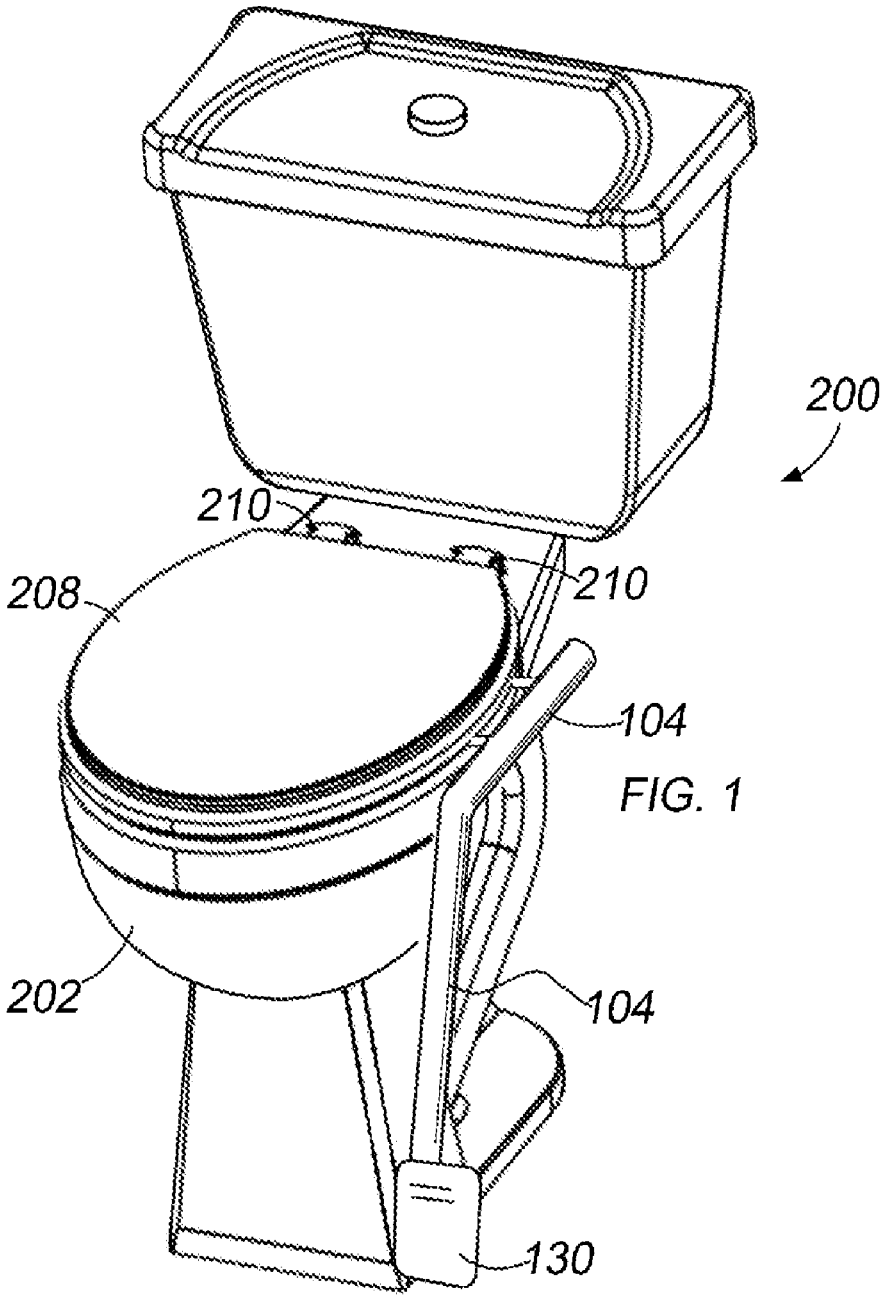
FIG. 1 is a perspective view of a general implementation according to the present invention.

100 seat lifter
104 actuator
110 upper pivot member
120 coupler

124 lower pivot member
126 attachment member
127 attachment member plate
128 guide
129 guide plate
130 foot plate
200 toilet
202 bowl
204 bowl rim
206 toilet seat
208 toilet lid
210 hinge

DETAILED DESCRIPTION OF THE EMBODIMENTS

Although methods and materials similar or equivalent to those described herein can be used in the practice or testing of this disclosure, suitable methods and materials are described below. It should be understood that the objects, features and aspects of any implementation or embodiment disclosed herein may be combined with any object, feature or aspect of any other implementation/embodiment without departing from the scope of the invention. The term "comprises" means "includes."

Referring generally to FIGS. 1-10, a toilet seat lifting apparatus includes a foot operated actuator (104) configured to be attachable to a toilet bowl (202). The actuator is connected to a guide member (128) and an upper pivot member (110). The upper pivot member is joined to a coupler (120). Typically, when the actuator is moved forward by foot motion, the guide member slides along the toilet rim (204) and a distal end of the actuator is pivoted upwardly, and by way of the upper pivot member, forces the coupler to bear against the underside of a toilet seat (206) which raises the seat. In some implementations, the coupler may be affixed to the underside of the toilet seat. In some implementations, a lower pivot member (124) is connected to both the coupler and an attachment member (126) which is affixed to the top surface of the toilet bowl. In such cases, when the actuator (104) moves forward, the lower pivot member (124) and the upper pivot member (110) pivot upwardly, and force the coupler (120) against the underside of the toilet seat (206), raising it. In some of the figures, the toilet seat hinges are shown; e.g., (FIG. 4), while in others the hinges are omitted. Whatever the particular hinge configuration for a particular toilet assembly, implementations of the invention may be adapted or modified by lengthening pivot members (110, 124), altering the basic dimensions of the coupler (120) or attachment member (126) to accommodate any type of toilet assembly without diverging from the teachings of the disclosed invention.

FIG. 1 is a perspective view of a general example implementation according to the present invention, mounted to a toilet with the toilet seat (206) and lid (208) in the down position.

Figure 2:
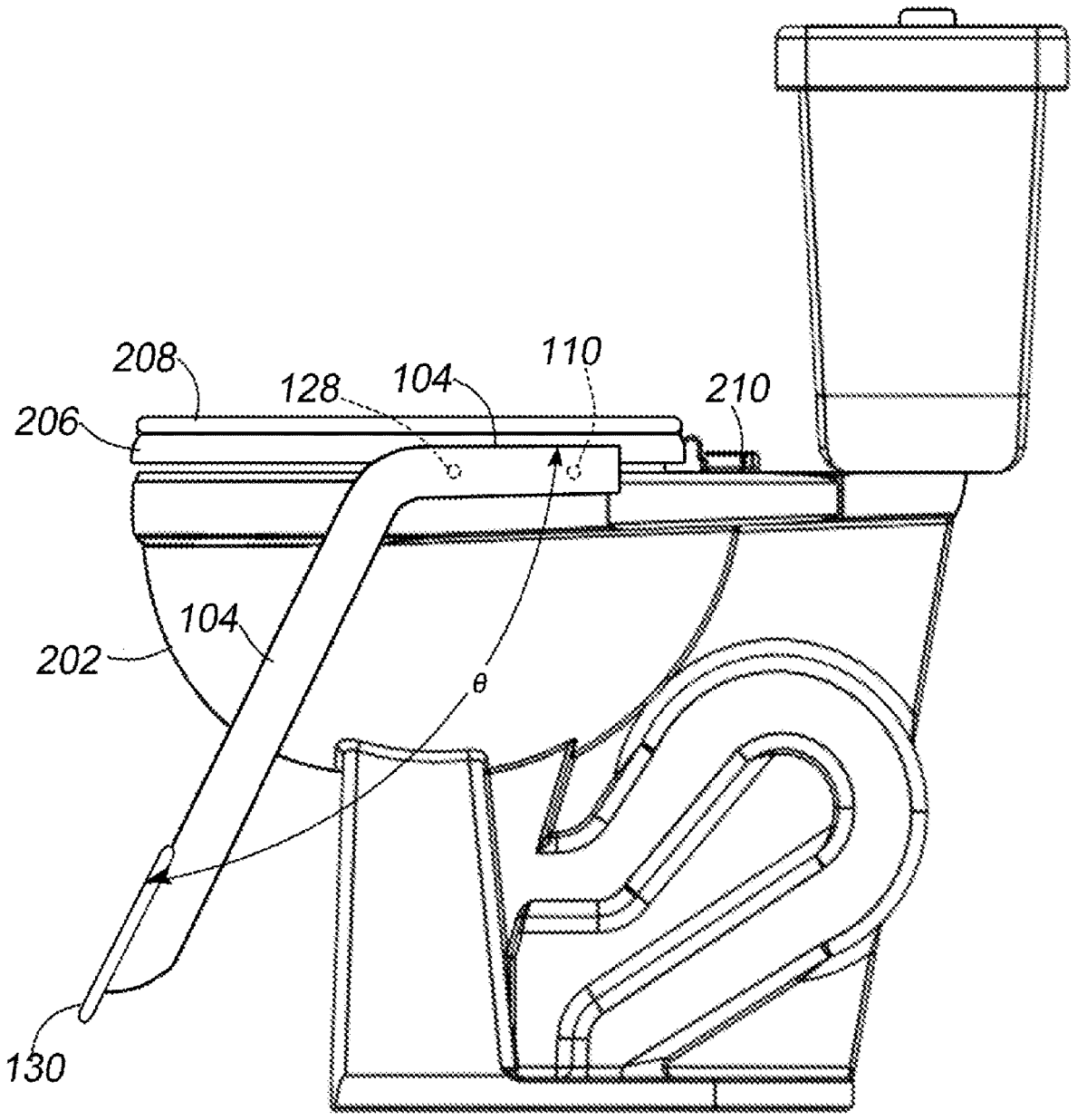
FIG. 2 is a side elevation thereof.
Figure 3:
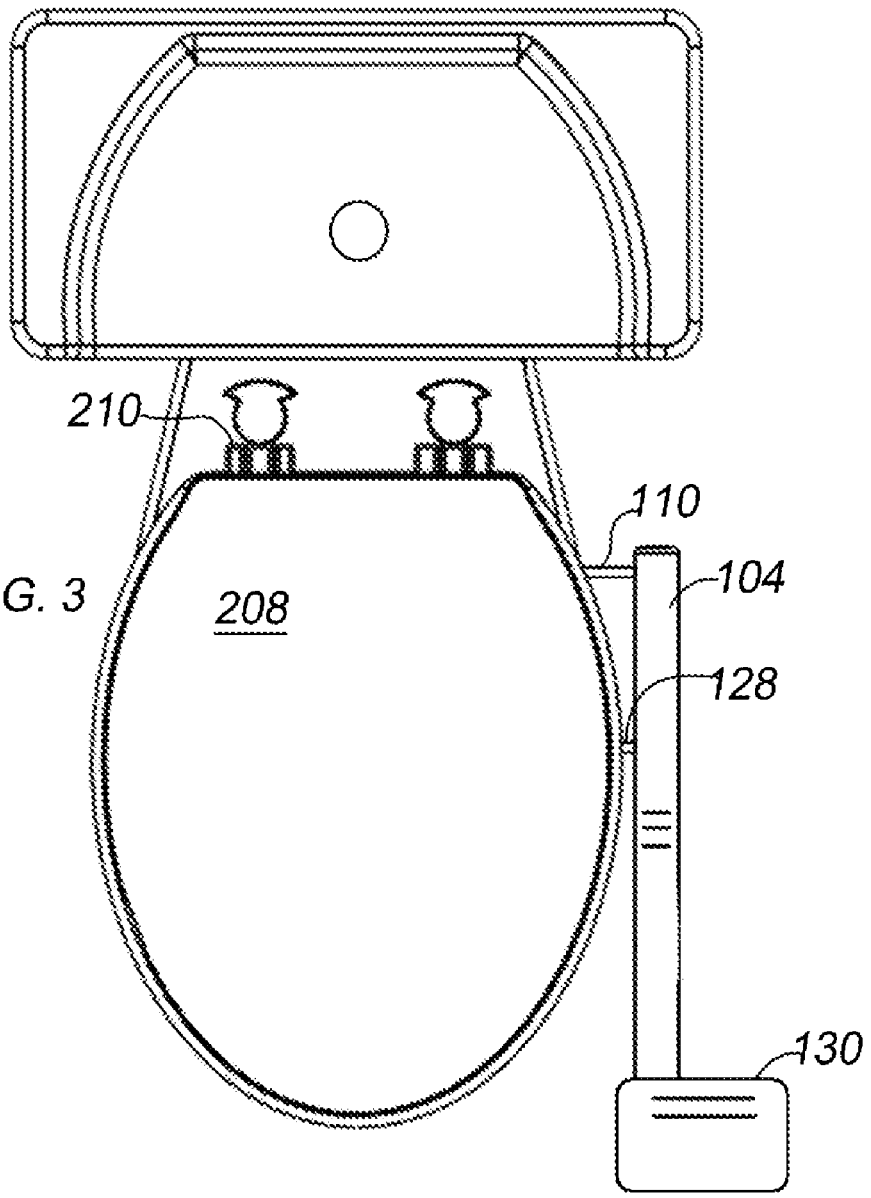
FIG. 3 is a top plan view thereof.

FIGS. 2 and 3 depict respectively, a side elevation and top plan view of the general implementation shown in (FIG. 1), and illustrate the general relationship between the actuator (104) and the upper pivot member (110) and guide (128). While the upper portion of actuator (104), and more particularly, the guide member (128) and upper pivot members (110) are substantially parallel to the longitudinal axis of the toilet bowl when the seat is closed, angle (θ) (FIG. 2) between may vary according the type of toilet.

Figure 4:
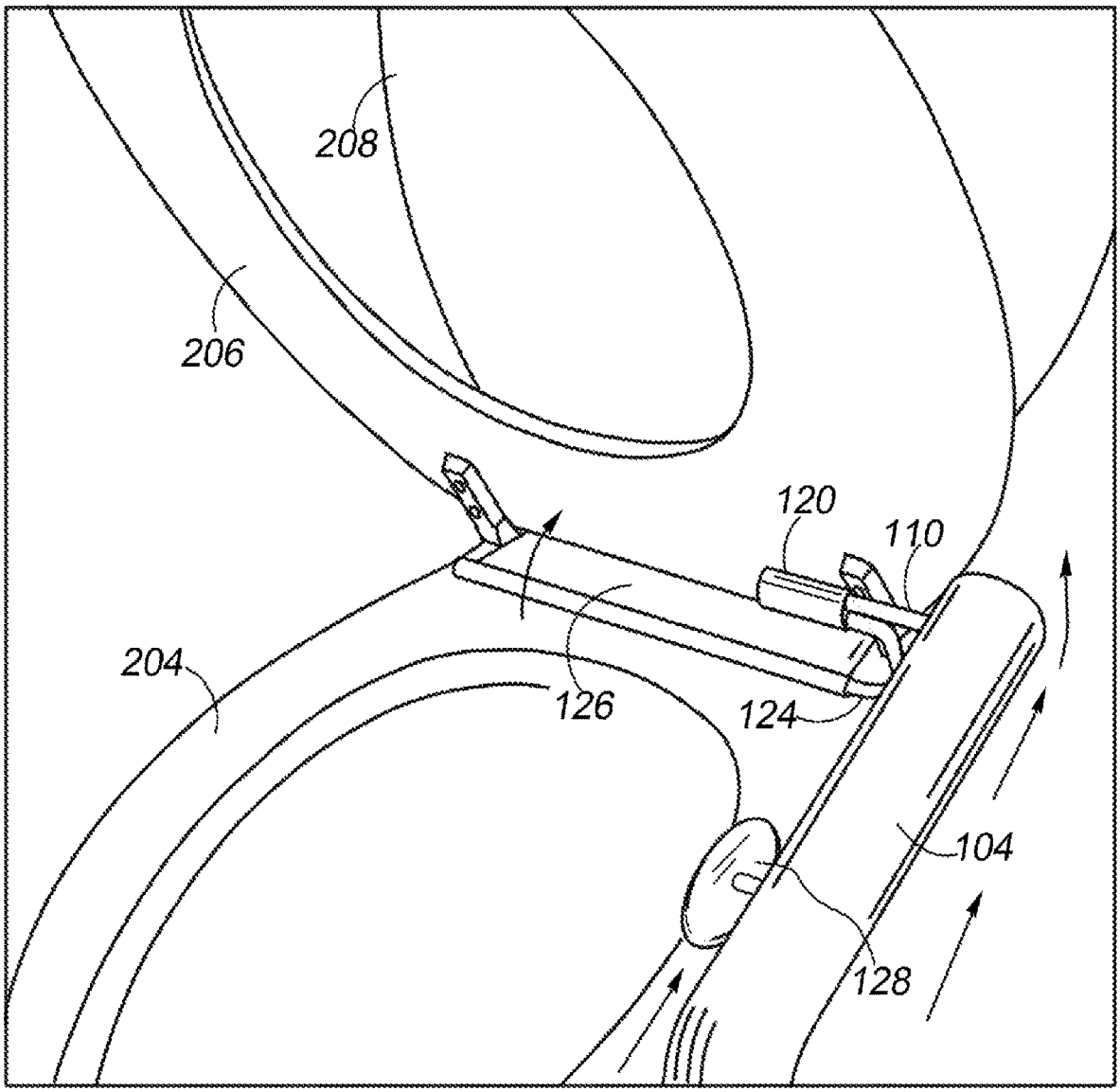
FIG. 4 is a perspective view thereof.

FIG. 4 is a perspective view showing actuator (104) connected to guide (128) and upper pivot member (110) which is connected in turn to coupler (120). Guide (128) may be a plastic element that slides over or against the toilet rim, and may take the form of a post extending from the actuator or include a flattened pad. Portions of the guide in contact with the rim are constructed of a non-marring material that will not scratch porcelain. Upper pivot member (110) is connected to actuator rotatable within coupler (120). Like the guide, coupler (120) is constructed of a non-marring material that will not damage the toilet seat when moved thereagainst. As shown, in some implementations, the coupler is unattached to the underside of the toilet seat (206) and swings upwardly and against the underside of the seat by the action of lower pivot (124) and upper pivot (110). The distance between the coupler and that portion of the lower pivot member connected to the attachment member determines the swing radius of the coupler. Lower pivot member (124) typically includes a bend between the first end of the lower pivot member and a second end joined to coupler (120). Normally, the swing radius is between 50 and 150 mm, but can vary according to the particular make and model of toilet assembly. Attachment member plate (127) may be relatively thin, e.g., 1-4 mm, and may be placed between the hinges of a toilet seat and the bowl, held in place by the hinge fasteners, or, the plate may be affixed to the bowl by adhesive. Attachment member (126) also includes a barrel or annulus (127) configured for the reception and retention of a first end of the lower pivot member (124).

Figure 5:
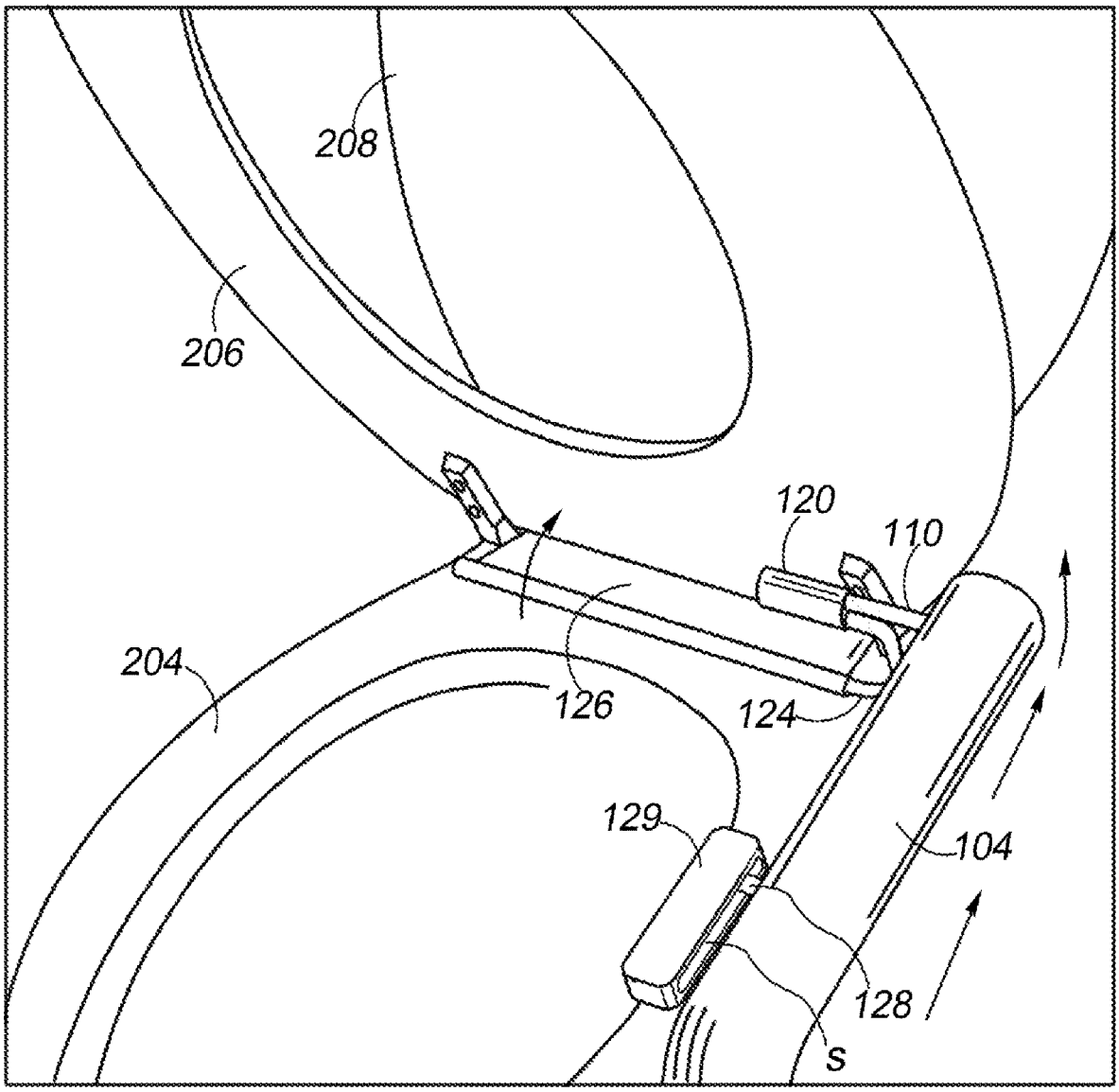
FIG. 5 is a perspective view of a second example implementation thereof.

FIG. 5 is a perspective of a second example implementation that shows guide (128) which may be a pin, post or flange configured to move forward and backward within guide plate slot (s) which may be a shallow longitudinal recess or groove. Guide plate (129) may be affixed to rim (204) by adhesive or other suitable fastening means. Guide plate (129) may have portions (not shown) that clip over the lip of the rim. The dimensions of guide plate (129) are merely exemplary, exaggerated somewhat for purposes of illustration, and it intended that the guide plate should be sized to permit a toilet seat to be fully closed without displacement of the seat.

Figure 6:
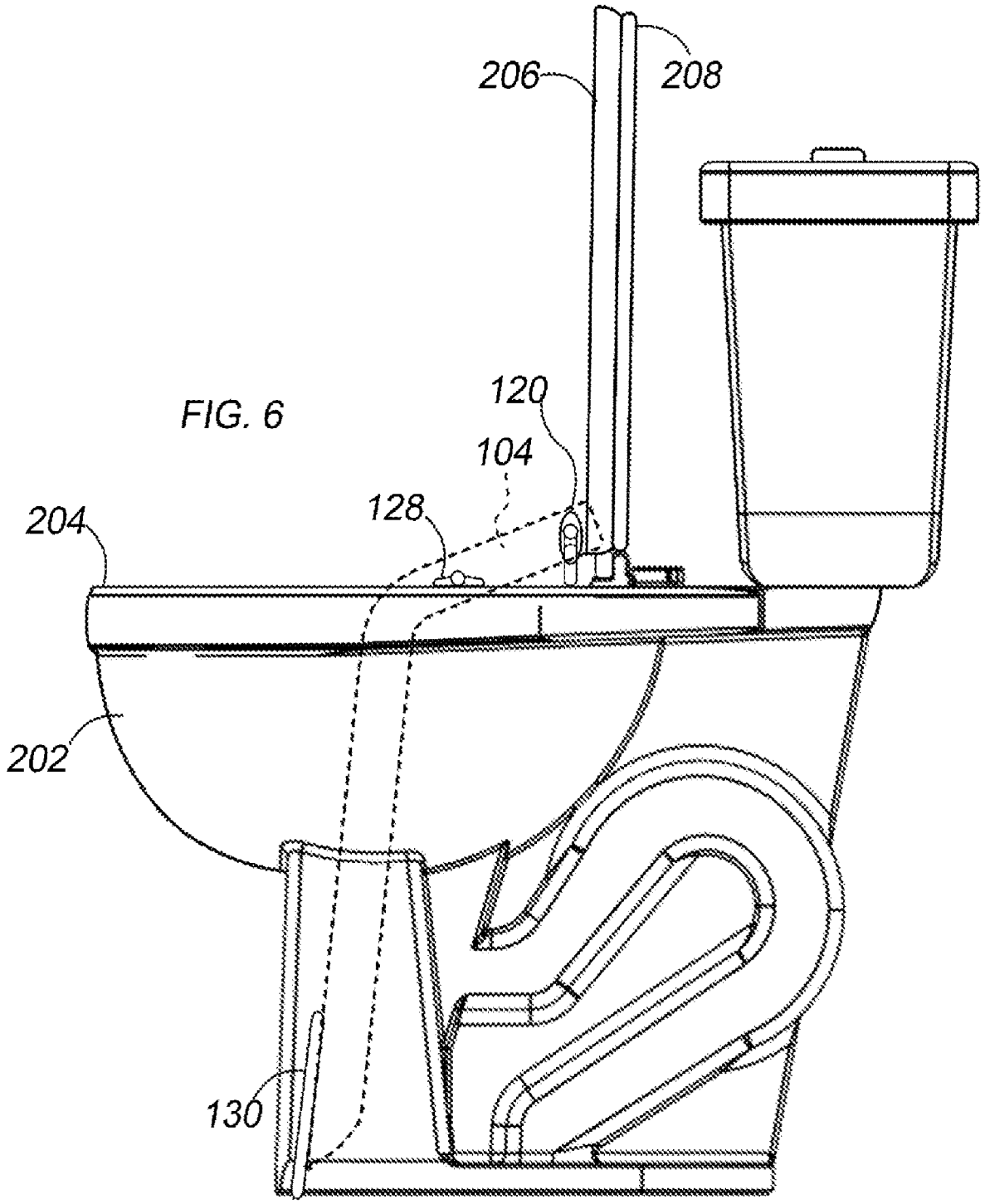
FIG. 6 is a side elevation of the implementation shown in (FIG. 4)

FIG. 6 is a side elevation of the implementation shown in (FIG. 4), that shows a distal end of actuator (104) pivoted up, with toilet seat (206) and lid (208) in a raised position. As mentioned previously, the swing radius of lower pivot member (124) may vary and it is possible that a relatively shorter radius will not raise the toilet seat to the substantially vertical orientation as shown, but such that the seat is inclined slightly in the direction of the bowl. Accordingly, it is possible that lifting of the seat may be accomplished by pushing foot plate until the actuator has reached its forward limit, at which point in order to close the seat, one simply allows the actuator to move backward, lowering the seat by gravity; i.e., the mass of the seat bearing against the coupler and upper pivot member. In other configurations, the seat may be fixed in a substantially upright position once the actuator has reached its forward limit. In such cases, a user may use his heel to pull the actuator in the backward direction and close the seat. Opening and closing behavior of the seat may be altered by selecting an appropriate swing radius, setting the pivot tension; e.g. friction, of the lower pivot member (124). In some installations, tapping the foot plate of the actuator may cause the seat to lower.

Figure 7:
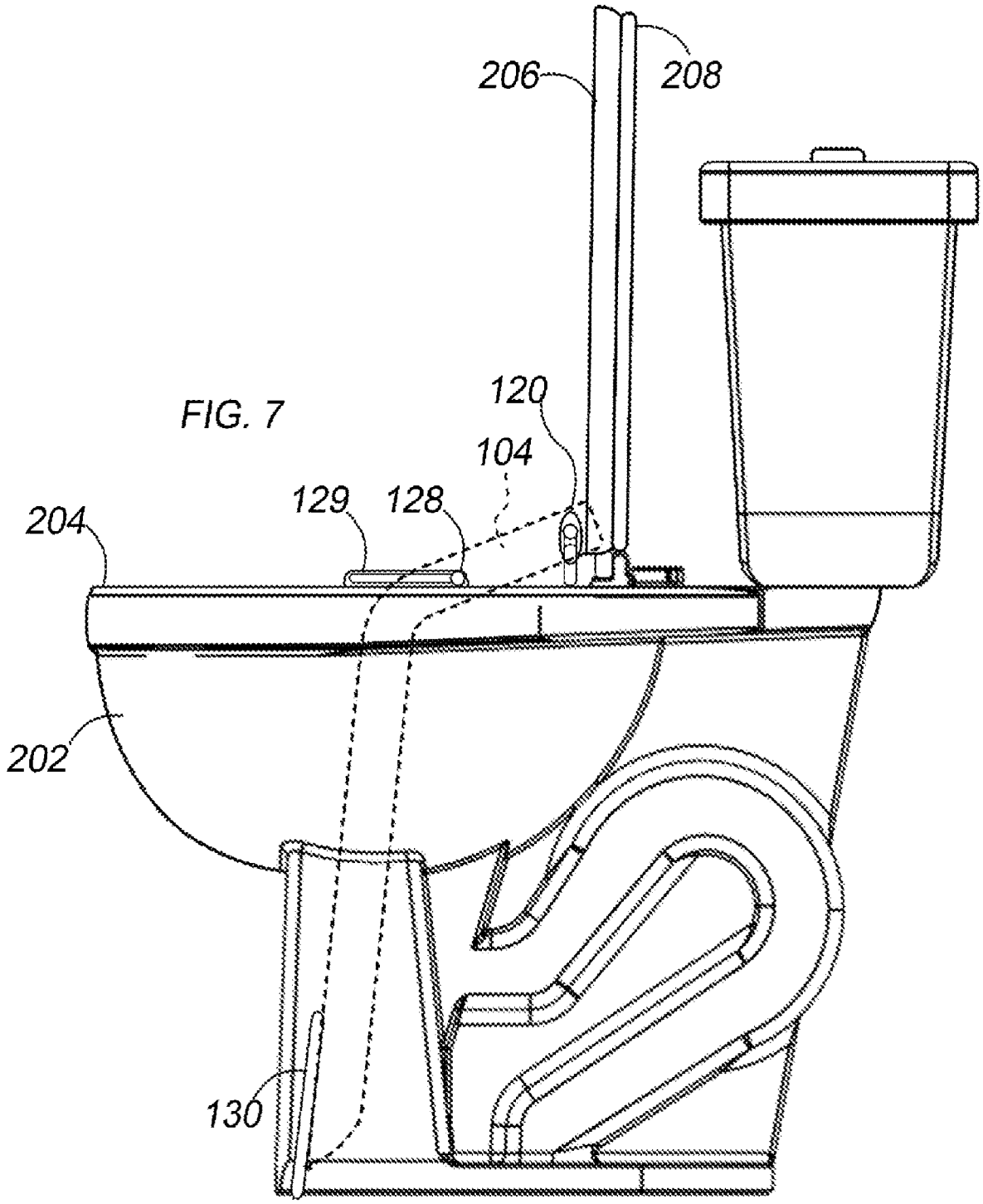
FIG. 7 is a side elevation of the implementation shown in (FIG. 5)

FIG. 7 is a side elevation of the implementation shown in (FIG. 5). Note that by changing the sliding resistance between guide (128) and guide plate (129), the opening and closing behavior of the seat may be altered. In some cases the friction between any of the moving parts may be increased/modified in order to increase or decrease the descent of the seat.

Figures 8, 8A:
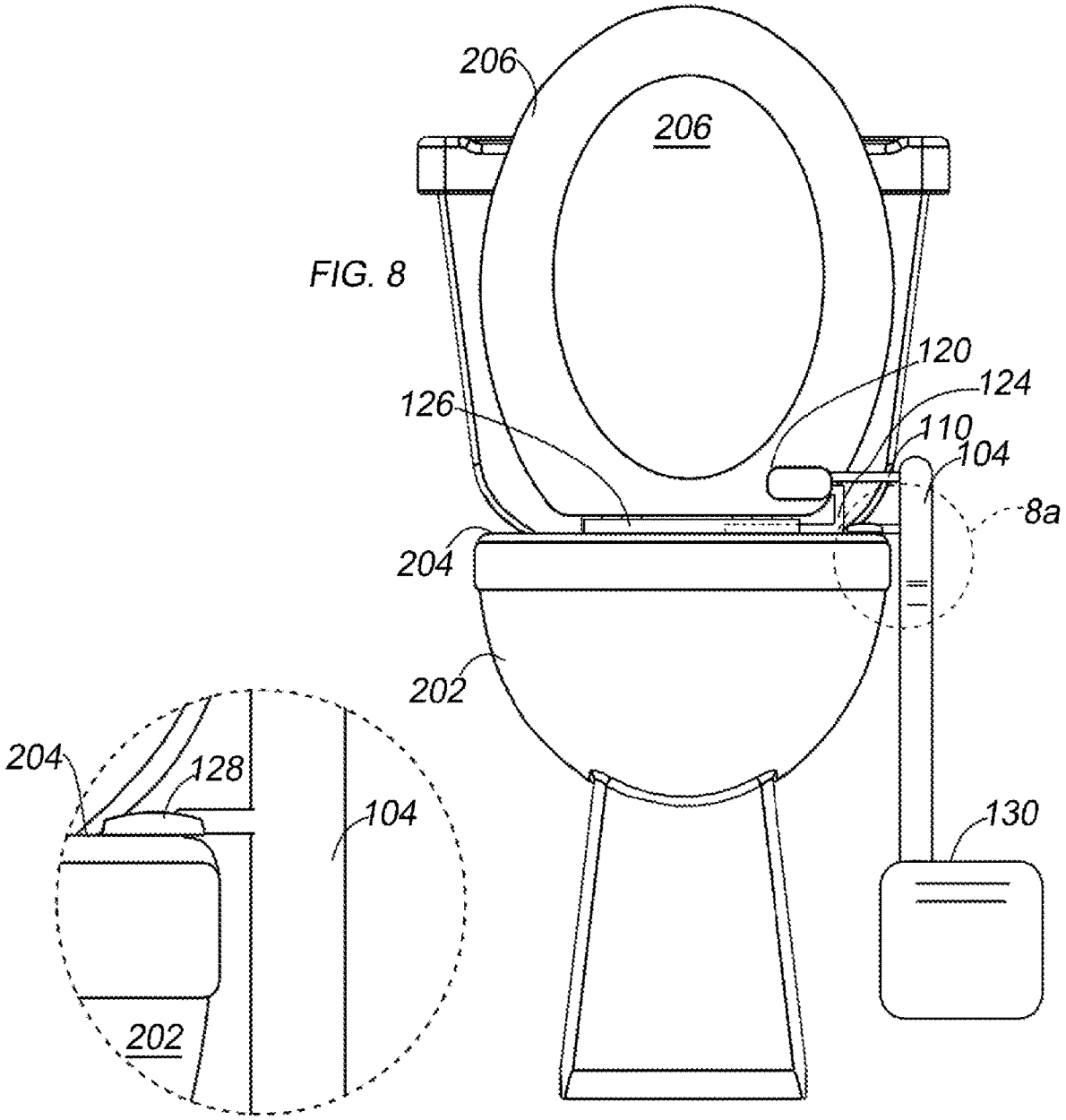
FIG. 8 is a front side elevation of the implementation shown in (FIG. 4)
FIG. 8A is a detail view of call-out 8*a* in (FIG. 4)

FIG. 8 is a front side elevation of the implementation shown in (FIG. 4). Guide (128) and coupler (120) are shaped, sized and contoured to be easily cleanable. FIG. 8A is a detail view of call-out 8*a* in (FIG. 4). It is possible that in some implementations, the actuator, coupler, upper pivot member, guide and lower pivot member may be readily removed for cleaning. In some implementations, only the lower pivot member is connected to the toilet by way of the attachment member. In some cases, the connections between the lower pivot member and the attachment member and the coupler to the lower and upper pivot members is a friction fit.

Figure 9:
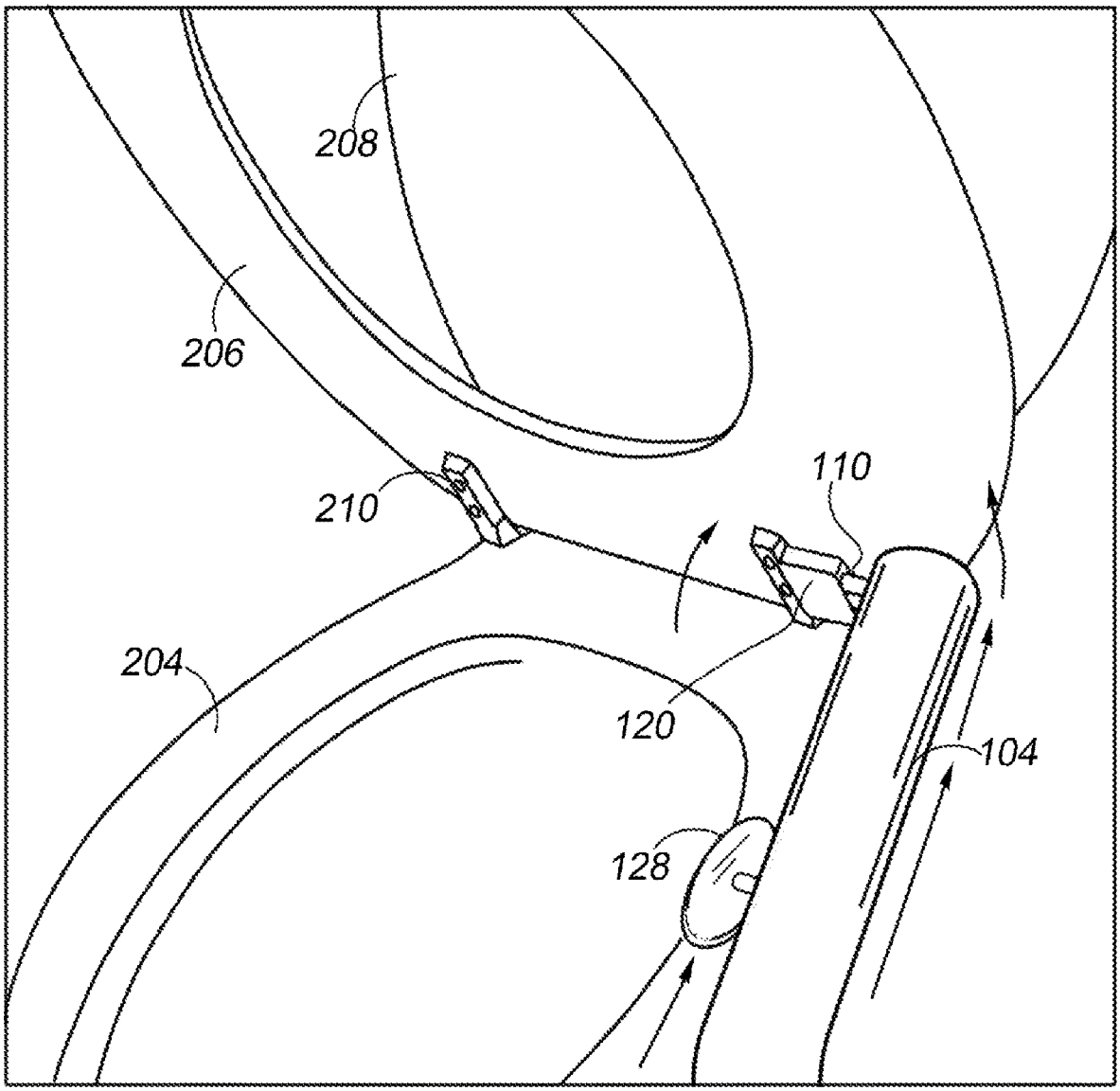
FIG. 9 is a perspective view of a third example implementation
Figure 10:
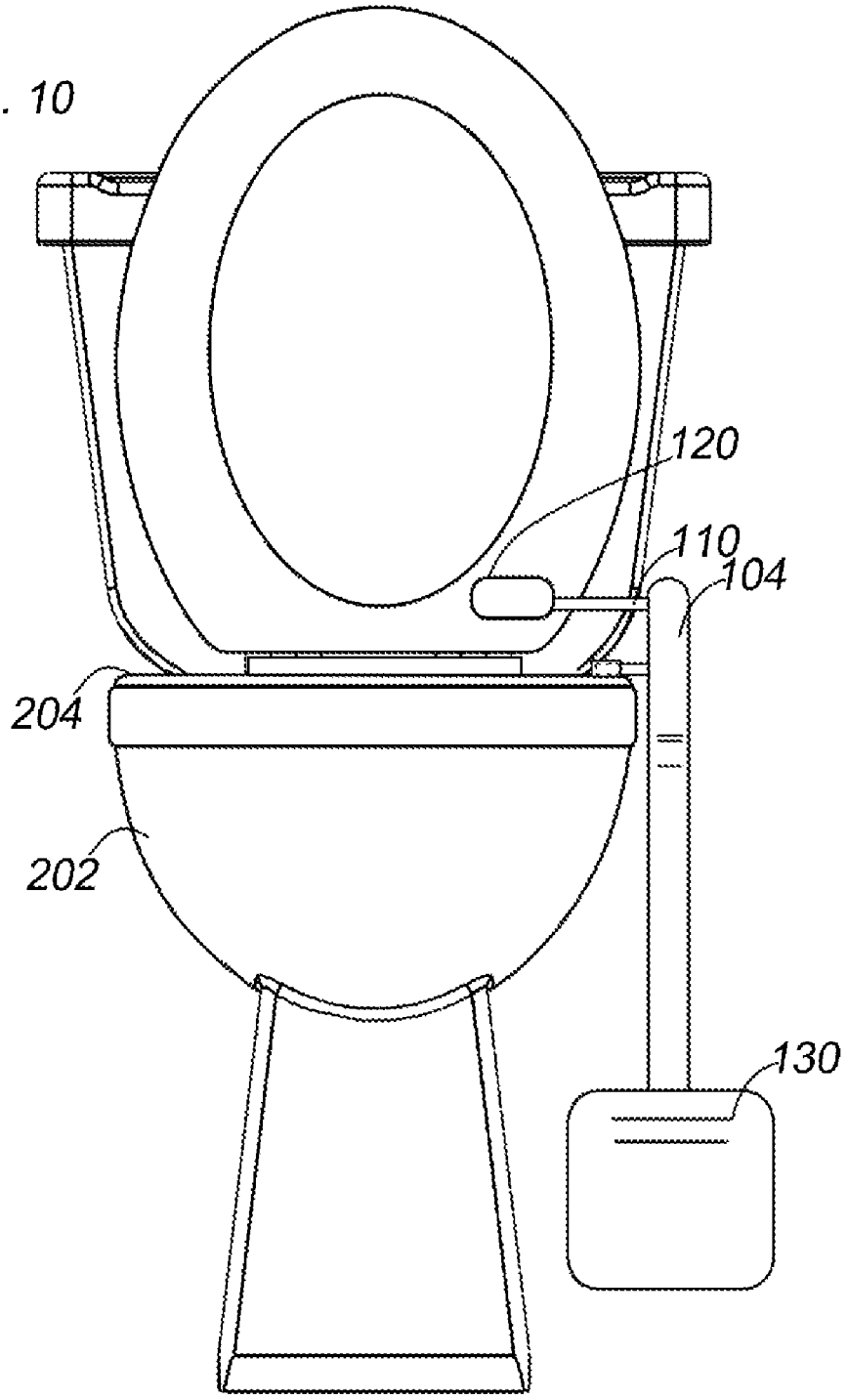
FIG. 10 is a front side elevation of the implementation shown in (FIG. 9)

FIG. 9 is a perspective view of a third example implementation that includes only the upper pivot member (110) which is pivotably connected to coupler (110) which may be affixed to the underside of seat (206). Like the other implementations disclosed, the length of pivot member (110) and the position of coupler (120) may be varied to accommodate different toilet assemblies.

What is claimed is:

1. An apparatus for sanitarily lifting a toilet seat, comprising:

an upper pivot member configured to pivot within a coupler, the coupler in contact with an underside of the toilet seat and the coupler raiseable by movement of the upper pivot member;

a guide member;

an actuator member attached to the upper pivot member and the guide member, and the actuator member includes at least a forward stroke motion and a reverse stroke motion, the guide member prompted by movement of the actuator in the forward and reverse direction to slide linearly along a rim of a toilet bowl, and, near an end of its forward stroke, a distal end of the actuator is configured to translate from a linear motion to pivot upwardly.

2. The apparatus according to claim 1, further comprising a guide plate coupled to the rim for receiving the guide member.

3. The apparatus according to claim 1, further comprising a foot contacting portion.

* * * * *